US005105846A

United States Patent [19]

Britt

[11] Patent Number: 5,105,846

[45] Date of Patent: Apr. 21, 1992

[54] WATER CONSERVING PURGE SYSTEM FOR HOT WATER LINES

[76] Inventor: Paul E. Britt, 5314 Ellenwood Dr., Los Angeles, Calif. 90041

[21] Appl. No.: 671,046

[22] Filed: Mar. 18, 1991

[51] Int. Cl.[5] ..... F24H 1/00

[52] U.S. Cl. ..... 137/337; 126/362; 417/12

[58] Field of Search ..... 126/362; 417/12; 137/337

[56] References Cited

U.S. PATENT DOCUMENTS

| | | | |
|---|---|---|---|
| 3,543,836 | 12/1970 | Paulson | 137/337 |
| 3,870,228 | 3/1975 | Moseley, Jr. | 126/362 |
| 4,142,515 | 3/1979 | Skaats | 126/362 |
| 4,628,902 | 12/1986 | Comber | 126/362 |
| 4,750,472 | 6/1988 | Fazekas | 417/12 |
| 4,936,289 | 6/1990 | Peterson | 126/362 |
| 4,945,942 | 8/1990 | Lund | 137/337 |

*Primary Examiner*—A. Michael Chambers
*Attorney, Agent, or Firm*—Donald D. Mon

[57] ABSTRACT

A purge line to return cooled water in a hot water line directly to a cold water line to avoid wasting water by draining the cooled water while awaiting arrival of hot water at a hot water outlet valve. The purge line is connected in near adjacency to a hot water outlet valve to minimize the amount of cooled water still in the hot water line between the purge line and the valve.

4 Claims, 1 Drawing Sheet

WATER CONSERVING PURGE SYSTEM FOR HOT WATER LINES

FIELD OF THE INVENTION

This invention relates to water conserving purge systems for domestic hot water lines.

BACKGROUND OF THE INVENTION

In domestic hot water systems, a water supply is connected to the cold water side of a hot water heater. In addition, the supply connects to all cold water outlets. Examples are cold faucets in lavatories, showers, bath tubs, and commodes.

The hot water side of the water heater is connected to all hot water outlets. Examples are hot faucets in laboratories, showers and bath tubs. Often both the hot and cold water lines are connected to respective sides of single handle mixer valves.

Also it is common for one water line to branch into a number of branch lines. One such example is for one bathroom to have its lines divided individually to supply the lavatories, shower and tub.

It is common practice for the hot water lines to be stagnant when the hot outlet valves are closed, and cover a period of time the water in that line will cool. Then when the hot water is turned on, cold water (or at least water not as hot as the heater supplies) will first be released. The conventional response to this situation is to let the water run until the hot water pipe to that outlet is purged of the cold water and is replaced by hot water from the water heater. This results in wasting the "slug" of water which was contained in the hot water line downstream from the water heater. It simply goes down the drain.

Such wastage has been conventionally acceptable for many years. Now, however, water supplies are much more sensitive to useless wastage than they formally were. Especially during times of drought, such wastage can be very expensive. In regions of very short water supplies, such as in remote well-based systems, such wastage is impermissible.

There are, of course, hot water recirculation systems which continuously circulate hot water so that the water in the hot water lines cannot cool. Hot water circuits in quality hotels and extra-quality homes frequently have these systems. Their penalty is the need for a second pipe loop for recirculation purposes, and the need to recirculate all of the water in the hot water circuit. The expense of the loop and of the continuing energy use are luxuries whose cost is not generally affordable.

It is an object of this invention to provide a purge system which purges a slug of cooled water downstream from the water heater an injects it into the cold water system without loss of water. This is accomplished in close adjacency to two faucet outlets in a branch from the main lines. The energy required is only that which is needed for pumping a rather small volume of previously-heated water, mostly in the branch line, from the hot water system into the cold water system, against only a trifling pressure differential.

The penalty is only that of waiting a few moments for this purge action to cause a replacement slug of hot water to enter into the hot water line to replace the purged water, and this will often take less time than would be required for the cold slug to be wasted through the hot water valve.

The savings of water and energy over the known art and practices, while small for each actuation do add up, especially when excessive use of water is heavily penalized. Also, it requires little plumbing, and in fact can be installed by anyone with rudimentary plumbing skills.

BRIEF DESCRIPTION OF THE INVENTION

This invention is used in a water supply system having a water heater supplied form a cold water line, which provides hot water to a hot water line. A water supply provides water under system pressure to the cold water line and thereby also to the water heater.

In practical installations, there are at least several branch lines, each having a pair of faucet outlets—one for hot and one for cold.

Each line has an outlet valve, such as a lavatory or shower faucet, and often the outlet valves are combined into a single mixing valve. More frequently there will be a hot water faucet and a cold water faucet, whose outputs are combined to emit from a single nozzle.

In every situation, there will be an adjustable outlet valve in the cold water line, and another in the hot water line.

These lines may further branch off to a plurality of outlet valves, in which event some of these branches may not be purged of cooled water, but the amount of unpurged water will generally be negligible.

A system according to this invention comprises a purge line interconnecting the hot water line and the cold water line. The purge line preferably taps in to the hot water line as closely as possible to the outlet valves.

A pump is incorporated into the purge line which, when energized, will draw water from the hot water line and inject it into the cold water line. A timer can control the duration of the pumping operation, if desired.

In some installation, there may be a plurality of hot water lines from the water heater. Examples are long lines extending to a kitchen, and others to various bathrooms. Then a purge line may be desired for each of these. However, the purge lines can be very short—often no longer than the distance between a hot water faucet valve and a cold water faucet valve.

The above and other features of this invention will be fully understood from the following detailed description and the accompanying drawing, in which:

DETAILED DESCRIPTION OF THE INVENTION

Figure 1:
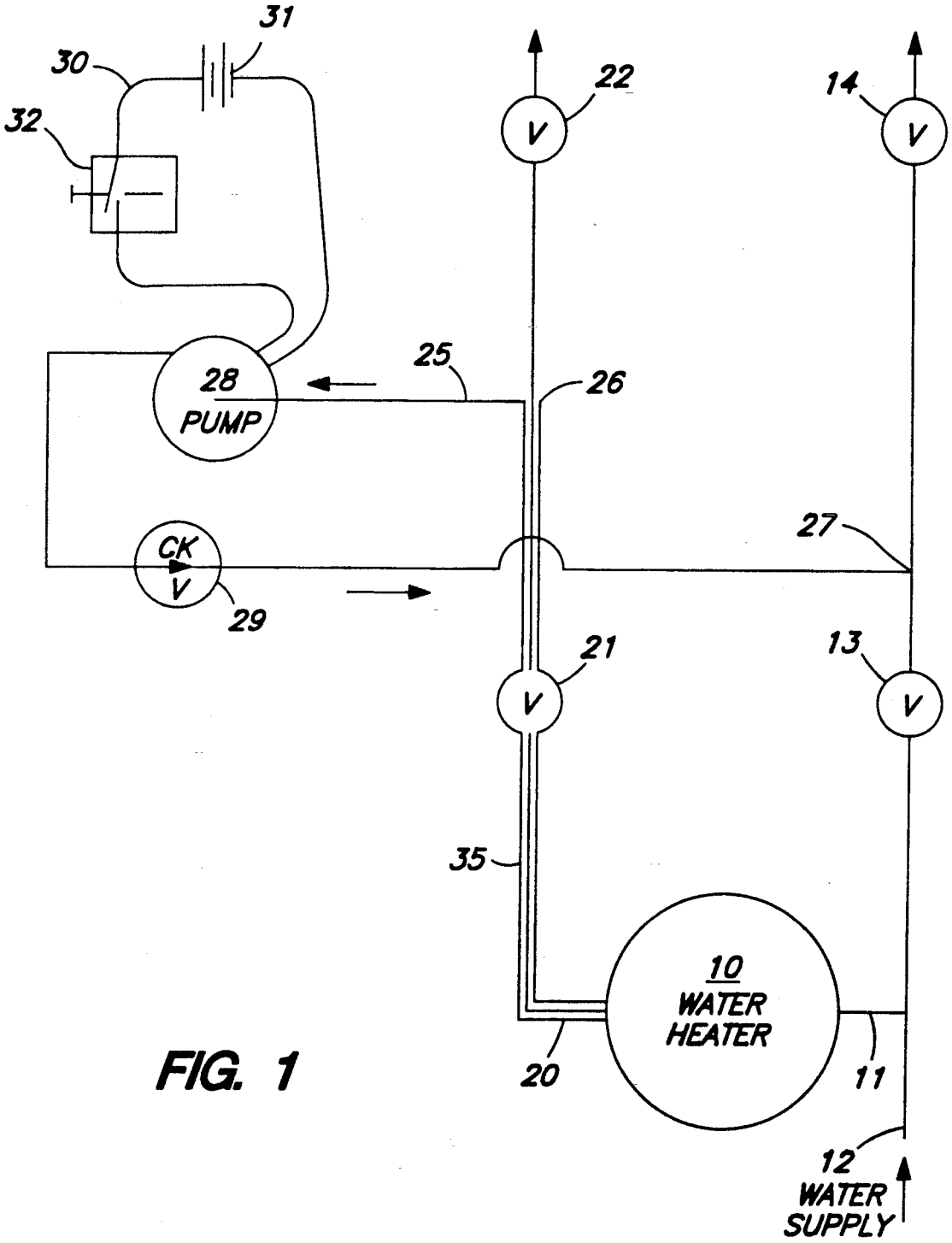
FIG. 1 is a a schematic drawing showing the presently-preferred embodiment of this invention.

A hot water heater 10 is shown receiving water from a cold water line 11. A water supply 12, such as a system main, supplies cold water to the cold water line.

Cold water line 12 incorporates a service valve 13, which is an off-on valve that enables servicing of downstream components. An outlet valve 14, such as a cold water faucet valve for a lavatory, is an adjustable off-on valve that enables or prevents discharge of cold water downstream. The discharge may be direct, or through a mixing vale, or through a pivoted nozzle or spout.

A hot water line 20 receives hot water from the water heater. It includes a service valve 21, and extends to an outlet valve 22, similar in function to valve 14.

A purge line 25 extends from a tap 26 in the hot water line to a tap 27 in the cold water line. The purge line incorporates a pump 28 and a check valve 29. Check valve 29 permits flow from the hot water line to the cold water line, but is prevents reverse flow. The pump when energized moves water from the hot water line to the cold water line. The differential pressure between the cold water line and the hot water line varies somewhat, depending on flow conditions in the two lines. Often they are essentially equal, and rarely if ever does the differential pressure exceed a very low value. Thus the pump can be quite small so that it will fit in limited space, and requires very little energy for operation. For the volumes involved, the length of the time the pump must run can be very short, on the order of only 20 to 30 seconds.

A pump energizing circuit 30 includes a current supply 31, and a switch 32. The switch can be manually closed when operation of the circuit is desired. While the circuit could be made to be actuated only while the switch is held closed, preferably it will instead include a timer element which, once energized, will hold the circuit closed for a predetermined, preferably adjustable, period of time.

For convenience in illustration, parts of the circuit are shown in FIG. 1 to the left of the hot water line. It will be understood that the purge line in fact need be no longer than the shortest distance between the taps. This will often be at or very near the outlet valves, a matter usually less than a foot or so.

It is to be expected that the hot water line may branch upstream from, or even downstream from the tap 26. In such an event, either more of these purge lines ma be provided, or the small amount of cold water in these other branches may be tolerated. There will still be an advantage from the purge of water upstream from the branch.

In whatever event, the purpose of this invention is to substitute the "slug" of cold water in heavier black lines 35 with hot water from the heater, without wasting the water. For this purpose the pump is actuated to withdraw this slug from the hot water line and transfer it to the cold water line. Hot water from the water heater will flow in to replace the withdrawn cold water.

As a consequence, with only a very brief wait, and without wastage of water, the user when he opens the outlet valve will quickly receive hot water.

All of this has been accomplished with only minimal plumbing and components. The cumulative savings in water and energy, plus the pleasure of quick hot water, justify the modest cost of this appliance.

This invention is not to be limited by the embodiment shown in the drawings and described in the description, which is given by way of example and not of limitation, but only in accordance with the scope of the appended claims.

We claim:

1. In a water distribution system which includes a cold water line, a hot water line, a water heater receiving cold water from the cold water line and supplying hot water to the hot water line, said cold water line receiving water from a water supply under pressure, said hot water line including a hot water outlet valve, and said cold water line including a cold water outlet valve, there being a substantial length of hot water line between said water heater and said hot water outlet valve in which a slug of hot water can be retained subject to being cooled when the hot water line is exposed to colder temperatures and the hot water outlet valve is closed for a substantial time, the improvement, comprising:

a purge line interconnecting said hot water line to said cold water line, from a location in said hot water line appreciably spaced from said water heater, and in near adjacency to said hot water outlet valve, there being in said spacing a slug of water between said location and said water heater;

pump means adapted to pump water through said purge line from said hot water line to said cold water line;

energizing means to energize said pump; and check valve means permitting flow through said pump line only toward said cold water line.

2. Apparatus according to claim 1 in which said energizing means includes timer means which when energized provides for energizing said pump for a predetermined length of time.

3. Apparatus according to claim 1 in which a service valve is incorporated in said hot water line between said water heater and said purge line, and in which another service valve is incorporated in said cold water line between said water supply and said purge line.

4. Apparatus according to claim 1 in which there is a plurality of said hot water lines and cold water lines in sets leading to respective valves, said lines connecting respectively to lines leading to the water heater and to the water supply, whereby a slug of water can be moved in each of said sets independently of movement of slugs in other sets.

* * * * *